US005279504A

United States Patent [19]

Williams

[11] Patent Number: 5,279,504

[45] Date of Patent: Jan. 18, 1994

[54] MULTI-DIAPHRAGM METERING PUMP

[76] Inventor: James F. Williams, 21325 Placerita Canyon Rd., Newhall, Calif. 91321

[21] Appl. No.: 970,148

[22] Filed: Nov. 2, 1992

[51] Int. Cl.[5] ..... F04B 17/00

[52] U.S. Cl. ..... 417/393; 417/395

[58] Field of Search ..... 417/392, 393, 394, 395

[56] References Cited

U.S. PATENT DOCUMENTS

| | | | |
|---|---|---|---|
| 3,205,830 | 9/1965 | Clack | 417/395 |
| 3,312,172 | 4/1967 | Harklau et al. | 417/393 |
| 3,814,548 | 6/1974 | Rupp | 417/395 |
| 4,761,118 | 8/1988 | Zanarini | 417/393 |
| 4,830,586 | 5/1989 | Herter et al. | 417/395 |
| 4,856,969 | 8/1989 | Forsythe et al. | 417/395 |

*Primary Examiner*—Richard A. Bertsch
*Assistant Examiner*—Alfred Basichas
*Attorney, Agent, or Firm*—Lyon & Lyon

[57] ABSTRACT

A multi-diaphragm metering pump having first and second diaphragms mounted in a body in substantially parallel relationship, wherein an open fluid communication path is provided within the body between adjacent sides of the diaphragms and wherein each diaphragm forms a sealed wall within the body. A diaphragm stem connects the diaphragms, such that movement of the first diaphragm will cause movement of the second diaphragm substantially in unison. A source of pressurized fluid is intermittently injected into and exhausted from a remote side of the first diaphragm, thereby causing cyclical movement of the two diaphragms, whereby a transient fluid may be pumped on the remote side of the second diaphragm by the cyclical movement. In a preferred embodiment, a sealed enclosure is formed between the two diaphragms.

28 Claims, 7 Drawing Sheets

MULTI-DIAPHRAGM METERING PUMP

BACKGROUND OF THE INVENTION

The present invention relates to metering pumps for pumping precise amounts of fluids and, more particularly, to a pneumatically driven, multi-diaphragm fluid injection metering pump.

It is known to use displacement pumps for high pressure chemical injection applications. These pumps may be driven and controlled pneumatically whereby pressurized air, or some other fluid, is pulsed intermittently to a power unit of the pump, which typically comprises driving a piston through a cylinder. The pneumatic controller may be set to pulse at any rate within the pump's operating range. For instance, if controlled from a metering device in the discharge flow line, the pneumatic controller triggers the fluid supply to the pump power unit at a rate proportional to said flow line. A pneumatic controller for injection pumps is shown in U.S. Pat. No. 3,387,563, issued Jun. 11, 1968.

In a known multi-stage pump, a drive piston in a "motor" chamber, moves a pumping piston of smaller diameter in an adjacent "pumping" chamber, which in turn displaces a pumping diaphragm. The differential between the surface area of the drive piston over that of the pumping piston effects a proportional increase in pressure supplied to the pumping chamber. To illustrate, suppose in a particular embodiment of a multi-stage pump, the surface area of the drive piston is A $in^2$, and the surface area of the pumping piston is A/4 $in^2$, thereby providing a 4:1 power ratio. For an input pressure of B psi. from the controller, the force exerted on the pumping piston would B*A lbs. Thus, the pressure within the pumping chamber due to the pumping piston would be $A*B \div A/4 = 4B$ psi. Thus, a multi-stage configuration is useful where the source of the pressurization driving the pump is not sufficient to overcome the pressure in the discharge line.

Pumping diaphragm failures can occur in high pressure applications because of the difference in pressure on the "pumping" side of the diaphragm, i.e., that side adjacent the pumping intake and discharge chamber, versus the "drive" side of said diaphragm, i.e., that side adjacent the pumping piston. This pressure differential is magnified as a pumping stroke takes place and the pressure exerted by the pumping piston on the middle area of the drive side of the diaphragm causes the transient fluid located on the pumping side to exert a counteracting force upon the outer circumference of the pumping side, which, over time, can cause ruptures. Further, because of the flexible properties inherent in a diaphragm, energy translated by the drive and pumping pistons, respectively, to the pumping diaphragm and exerted on the transient fluid is wasted "pushing" the transient fluid back against the outer circumference of the pumping side of the diaphragm, instead of out the discharge line.

The drive piston must be effectively sealed within the motor chamber pump housing in order to prevent the pressurized fluid from "escaping" around the piston and into the interior of the pump housing, thereby weakening the force the fluid exerts on the piston and causing the pump to fail. However, because of the constant movement of the drive piston, seals for this type of application are subject to heavy wear and failure, requiring that the pump be shut down frequently for repairs.

The present invention is directed at providing an improved multi-stage pump that does not require motor chamber piston seals and has means for equalizing the pressure exerted on both sides of the pumping diaphragm, thereby reducing the susceptibility of the pump to seal and diaphragm failures.

SUMMARY OF THE INVENTION

A pneumatically controlled multi-diaphragm pump is provided, comprising a first, "pressurizing" diaphragm and a second, "pumping" diaphragm mounted in adjacent, exposed chambers of a pump housing, said diaphragms positioned substantially parallel and fixedly connected by a diaphragm stem for movement in unison, and each having an adjacent side facing the other diaphragm and a remote side facing away from the other diaphragm. A source of pressurized fluid is intermittently injected into and exhausted from the remote side of the pressurizing diaphragm, thereby causing cyclical movement of said pressurizing and pumping diaphragms, respectively. A source of transient fluid to be pumped is drawn into, and discharged from, the chamber at the remote side of the pumping diaphragm by the cyclical movement of said pumping diaphragm.

Each diaphragm forms a seal within its respective chamber of the pump housing, such that a sealed enclosure of fluid, (e.g., air), having a constant volume is formed between the adjacent sides of said diaphragms. As the pressurized fluid causes displacement of the pressurizing diaphragm towards the pumping diaphragm and into the sealed enclosure between said diaphragms, the pressure of the fluid trapped therein rises and, thereby, exerts a force against the adjacent side of the pumping diaphragm. This "pressurization" force is in addition to the force exerted by the diaphragm stem due to the displacement of the pressurizing diaphragm. Thus the movement of the pumping diaphragm is influenced both by its connection to the pressurizing diaphragm via the diaphragm stem and by the resulting pressurization force created by the inward displacement of the pressurizing diaphragm into the sealed enclosure between the two diaphragms. This pressurization force against the adjacent side of the pumping diaphragm acts counter to the force exerted by the transient fluid against the remote side, partially equalizing the pressure across said pumping diaphragm and thereby reducing the likelihood of diaphragm ruptures, over time.

Further, by using a fixed, sealed diaphragm in lieu of a piston to "drive" the pump's power unit, there is no need to provide any piston sealing mechanism, thereby decreasing the likelihood of leaks and pressure failures. As such, there is a corresponding decrease in the "down time" of the pump for repairs.

Accordingly, it is an object of the present invention to provide an improved injection pump utilizing a greater amount of the power supplied by an input pressure source, while decreasing the likelihood of an internal diaphragm rupture or seal failure.

Other objects and features of the present invention will become apparent from the following detailed description taken in connection with the accompanying drawings.

BRIEF DESCRIPTION OF THE DRAWINGS

It is to be understood that the drawings are designed for the purpose of illustration only, and are not intended as a definition of the limits of the invention. The drawings, wherein similar reference characters denote similar elements throughout the several views, illustrate preferred embodiments of the invention, as follows.

DETAILED DESCRIPTION

Figure 1:
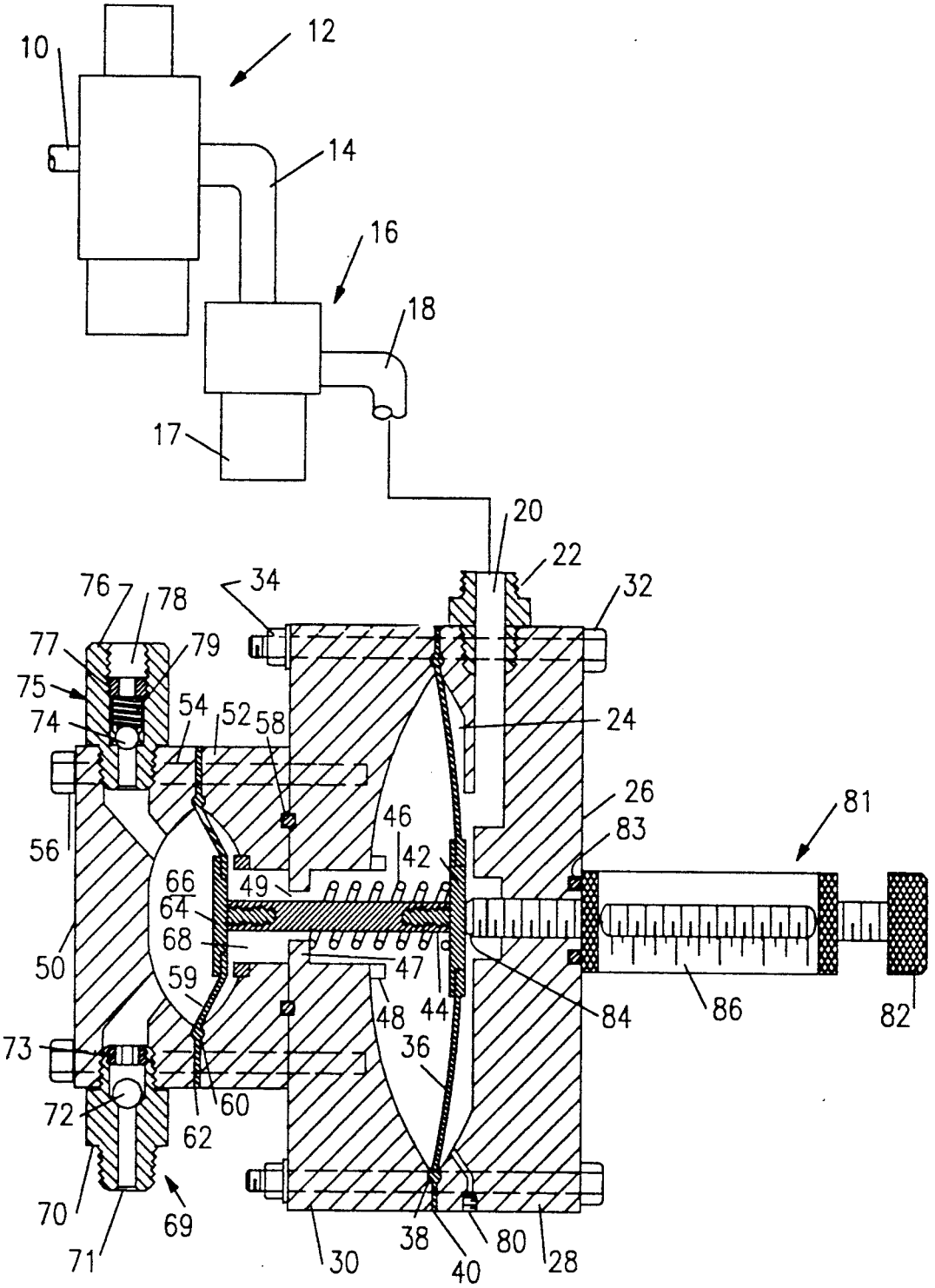
FIG. 1 is a cross-sectional view of a multi-diaphragm pump designed in accordance with the present invention.

Referring now to FIG. 1, a pneumatic controller 12 is connected to a source of pressurized fluid 10, and has a vent to atmosphere (not shown). In the embodiment shown, the source of pressurized fluid 10 may be supplied by compressed air tanks, or from a gas flow line into which the pump is discharging, (e.g., a natural gas line), or some other source. The pneumatic controller, such as shown in U.S. Pat. No. 3,387,563, has means for intermittently supplying and exhausting the pressurized fluid at controlled intervals through a feed line 14 into a quick exhaust valve 16. Valve 16, by means described in detail herein below, passes the intermittent pulses of the pressurized fluid into a pump supply line 18, and is also equipped with a rapid exhaust port 17. Through a hollow bore 20 of a nipple connector 22, the pressurized fluid from supply line 18 is alternately injected into and exhausted from a motor chamber 24 within a motor chamber housing 26 by the controller 12. Fluid exhausted from the motor chamber exits back through bore 20 and supply line 18, respectively, and exhausts out port 17 of valve 16.

Motor chamber housing 26 is comprised of an upper motor chamber housing plate 28 and a lower motor chamber housing plate 30, respectively, which are secured together by a plurality of bolts 32 and fastening nuts 34. The designations of housing plates 28 and 30 as "upper" and "lower," respectively, are to assist the reader in understanding the drawing from this description and are not intended to limit the pump housing to a particular vertical alignment.

The intermittent supply and exhaust of pressurized fluid acts to cyclically pressurize and depressurize the motor chamber 24 causing displacement of a first, pressurizing diaphragm 36 at a predetermined oscillatory rate as set by the controller. In the embodiment shown, pressurizing diaphragm 36 has a seal portion 38 and an outer gasket portion 40, respectively, which are clamped and sealed between the upper and lower motor chamber housing plates. The seal and gasket portions of the pressurizing diaphragm are secured by the plurality of bolts 32 and fastening nuts 34, respectively, thereby isolating that side of the pressurizing diaphragm adjacent to the upper motor chamber housing plate 28 from that side adjacent to the lower motor chamber housing plate 30.

An enforced center portion 42 of pressurizing diaphragm 36 is axially secured to one end of a rigid diaphragm stem 44, said diaphragm stem having a second end extending in a direction away from the upper motor chamber housing plate 38. A compression spring 46 encircles diaphragm stem 44 and extends between the pressurizing diaphragm and an annular spring retaining lip 47 around the circumference of an opening 49 in the lower motor chamber housing plate 30, said opening 49 accommodating said diaphragm stem. When the pressurizing diaphragm 36 is inwardly displaced into motor chamber 24, center portion 42 is engaged by a plurality of stop teeth 48 proximate the lower motor chamber housing plate 30 thereby restricting further inward movement of said diaphragm. Stop teeth 48 have grooves to allow fluid, (e.g., air), swept by the inward displacement of the pressurizing diaphragm in the motor chamber to pass through opening 49.

The second end of diaphragm stem 44 is secured to an enforced center portion 64 of a second, pumping diaphragm 59. Pumping diaphragm 59 is seated in a pumping chamber 66 within a pumping chamber housing 50. Pumping chamber housing 50 is comprised of an upper pumping chamber housing plate 52 and a lower pumping chamber housing plate 54, respectively, which are secured together by a plurality of bolts 56. As noted above, the designations of housing plates 52 and 54 as "upper" and "lower," respectively, are to assist the reader in understanding the drawing and are not intended to limit the pump housing to a particular vertical alignment.

The plurality of bolts 56 also secure the pumping chamber housing to the lower housing plate 36 of the motor chamber housing 26, such that the pressurizing and pumping diaphragms 36 and 59, respectively, are axially aligned in a concentric fashion substantially parallel to each other. Thus, the motor chamber housing and pumping chamber housing, as secured by bolts 56, comprise a single pump body which includes the two diaphragms, each sealed in its own chamber within said pump body.

A circular opening 68 in upper pumping chamber housing plate 52 is provided adjacent to opening 49 in lower motor chamber housing plate, and said openings are aligned so as to allow the diaphragm stem to extend between the motor chamber housing and the pumping chamber housing. An O-ring 58 is provided around openings 49 and 68 between the two chamber housings, effecting a seal between said openings.

In the embodiment shown, pumping diaphragm 59 has a seal portion 60 and an outer gasket portion 62, respectively, which are sealed between the upper and lower pumping chamber housing plates. The seal and gasket portions of the pumping diaphragm are secured by the plurality of bolts 56, thereby isolating that side of the pumping diaphragm adjacent to the upper pumping chamber housing plate 52 from that side adjacent to the lower pumping chamber housing plate 54.

Thus, it can be seen that the pressurizing and pumping diaphragms, as fixedly sealed in the adjacent motor and pumping chambers, respectively, form a sealed enclosure between adjacent sides of said diaphragms. Fluid, (e.g., air), may freely flow within that sealed enclosure, between the respective chambers, via openings 49 and 68. While the embodiment shown illustrates a particular molded construction of the pressurizing and pumping diaphragms, other ways of molding or forming will also suffice, and the invention is not to be limited to a particular molded construction design. For higher pressure applications, the pressurization diaphragm is provided with a larger diameter than the pumping diaphragm. The differential between the surface area of the pressurization diaphragm over that of the pumping diaphragm effects a proportional increase in pressure supplied to the pumping chamber. As such, the pump is capable of discharging at a greater pressure than the source of pressurization driving the pump.

Mounted in the lower pumping housing plate 54, is an inlet check valve 69, which comprises an inlet port 71, a valve housing 70 having a ball seat, a ball 72 and a ball retaining mechanism 73. The inlet check valve 69 communicates with the pumping chamber 66 on that side of pumping diaphragm 59 remote to the pressurizing diaphragm 36. Inlet port 71 is connected to a source of dispensed fluid to be pumped into an outlet or discharge flow line, (e.g., a liquid chemical), herein referred to as the "transient fluid." Opposite inlet valve 69, is a discharge check valve 75. Discharge valve 75 communicates with the pumping chamber 66 and has a ball 74, a ball retaining mechanism 77, a valve housing 76 having a ball seat and a discharge port 78. In the embodiment shown, ball 74 is urged toward the ball seat by a spring 79 which is compressed between the ball and the retaining mechanism 77 to effect a positive closing of the ball on the seat to prevent reverse flow of the pumped transient fluid. Retaining mechanism 73 is designed to allow the transient fluid to pass from inlet 71, around ball 72 and into the pumping chamber. Likewise, retaining mechanism 77 is designed to allow the transient fluid to pass from the pumping chamber, around ball 74 and through discharge port 78, respectively.

An operating cycle of the pump takes place as follows:

A "pumping" stroke occurs when pressurized fluid fills motor chamber 24 on that side of pressurizing diaphragm 36 remote to the pumping diaphragm, displacing said pressurizing diaphragm "inward" through the motor chamber from its most expanded position as shown in FIG. 1 to its most compressed position (See FIG. 3, described herein below). The inward displacement of the pressurizing diaphragm moves rigid diaphragm stem 44 and causes a corresponding "inward" displacement of the pumping diaphragm.

As the pressurized fluid causes displacement of the pressurizing diaphragm 36 towards the pumping diaphragm 59 and into the sealed enclosure between said diaphragms, the pressure of the fluid, (e.g., air), trapped therein rises and, thereby, exerts a force against the adjacent side of the pumping diaphragm 59. This "pressurization" force is in addition to the force exerted by the diaphragm stem 44 due to the displacement of the pressurizing diaphragm 36. Thus, the movement of the pumping diaphragm 59 is influenced both by its connection to the pressurizing diaphragm 36 via the diaphragm stem 44 and by the resulting pressurization force created by the inward displacement of the pressurizing diaphragm into the sealed enclosure between the two diaphragms. This pressurization force against the adjacent side of the pumping diaphragm 59 acts counter to the force exerted by the transient fluid against the remote side in the pumping stroke, partially equalizing the pressure across said pumping diaphragm and thereby reducing the likelihood of diaphragm ruptures, over time.

When the pressurizing diaphragm is fully compressed, the controller 12 stops supplying pressurized fluid to the pressurizing chamber and instead vents to atmosphere. Compression spring 46, which is compressed against annular retaining lip 47 by the inward displacement of the pressurizing diaphragm 36, causes the pressurizing diaphragm to undergo an "exhaust stroke" and pulls diaphragm stem 44 and the pumping diaphragm 59, respectively, "outward". This forces the now depressurized fluid in motor chamber 24 to exit said chamber.

During the pumping stroke, the force that is exerted by the inward displacement of the pumping diaphragm 59 on the transient fluid contents in the pumping chamber causes said transient fluid to move ball 74 in the discharge check valve 75 against the resistance of spring 79 thereby creating a passageway for said transient fluid to be pumped out of the pumping chamber by the pumping diaphragm 59 through outlet 78. At the same time, the force on the transient fluid in the pumping chamber causes ball 72 in the inlet check valve 69 to press against the ball seat of valve housing 70, thereby preventing any fluid in the pumping chamber from exiting through the inlet valve.

During an exhaust stroke of pressurizing diaphragm 36, when the "upward" movement of the pumping diaphragm is increasing the volume of the pumping chamber adjacent the lower pumping chamber housing plate 54, a vacuum is created which moves ball 72 away from the valve housing seat and against retaining mechanism 73, thereby allowing the vacuum pressure to draw the transient fluid into the pumping chamber through inlet 71 of inlet check valve 69. At the same time, the vacuum pressure allows ball 74 in the discharge check valve 77 to be urged by spring 79 toward and against the ball seat of valve housing 76, thereby preventing the discharged fluid from returning into the pumping chamber through discharge port 78.

A drain hole with a threaded plug 80 accesses the motor chamber through the upper motor chamber housing plate 28, and is provided to allow an operator to drain off any accumulated substances in the motor chamber caused by condensation or other factors.

By means of a stroke adjuster 81 mounted on and extending through the upper motor chamber housing plate 28 in an axial relationship to center portion 42 of the pressurizing diaphragm 36, the length of the stroke of diaphragm stem 44 can be varied to correspondingly alter the volume of the transient fluid delivered by the pump during each pumping cycle. Stroke adjuster 81 preferably includes an adjustment knob 82, an adjuster rod 84 and a calibration scale. The adjuster rod 84 threadedly engages the body 86 and/or housing plate 28 for advancing or retracting by rotation of knob 82. Circumscribing the stroke adjuster rod in the upper motor chamber housing plate is one or more o-rings 83 to prevent leakage of the pressurized fluid injected into the motor chamber.

The position of the stroke adjuster rod 84 can be varied axially with respect to the pressurizing diaphragm, as desired, for changing the volume pumped in each cycle. During an exhaust stroke, the end of the stroke adjuster rod engages the center portion 42 of said pressurizing diaphragm, thereby limiting the exhaust stroke length of diaphragm stem 44. By limiting the exhaust stroke length of the diaphragm stem, the amount of transient fluid drawn into the pumping chamber is correspondingly limited. Thus, as can be observed, if the stroke adjuster rod is in a completely retracted position, i.e., withdrawn from the motor chamber, maximum movement of the pressurizing and pumping diaphragms is allowed when the motor chamber is alternatively pressurized and depressurized. Conversely, the further the stroke adjuster rod is extended into the motor chamber, the more limited the movement of said diaphragms. The scale calibration, which can be externally attached to the pump housing, allows the user to predetermine and set the amount by the which the volume of a transient fluid delivered by the pump is increased or decreased.

Figure 2:
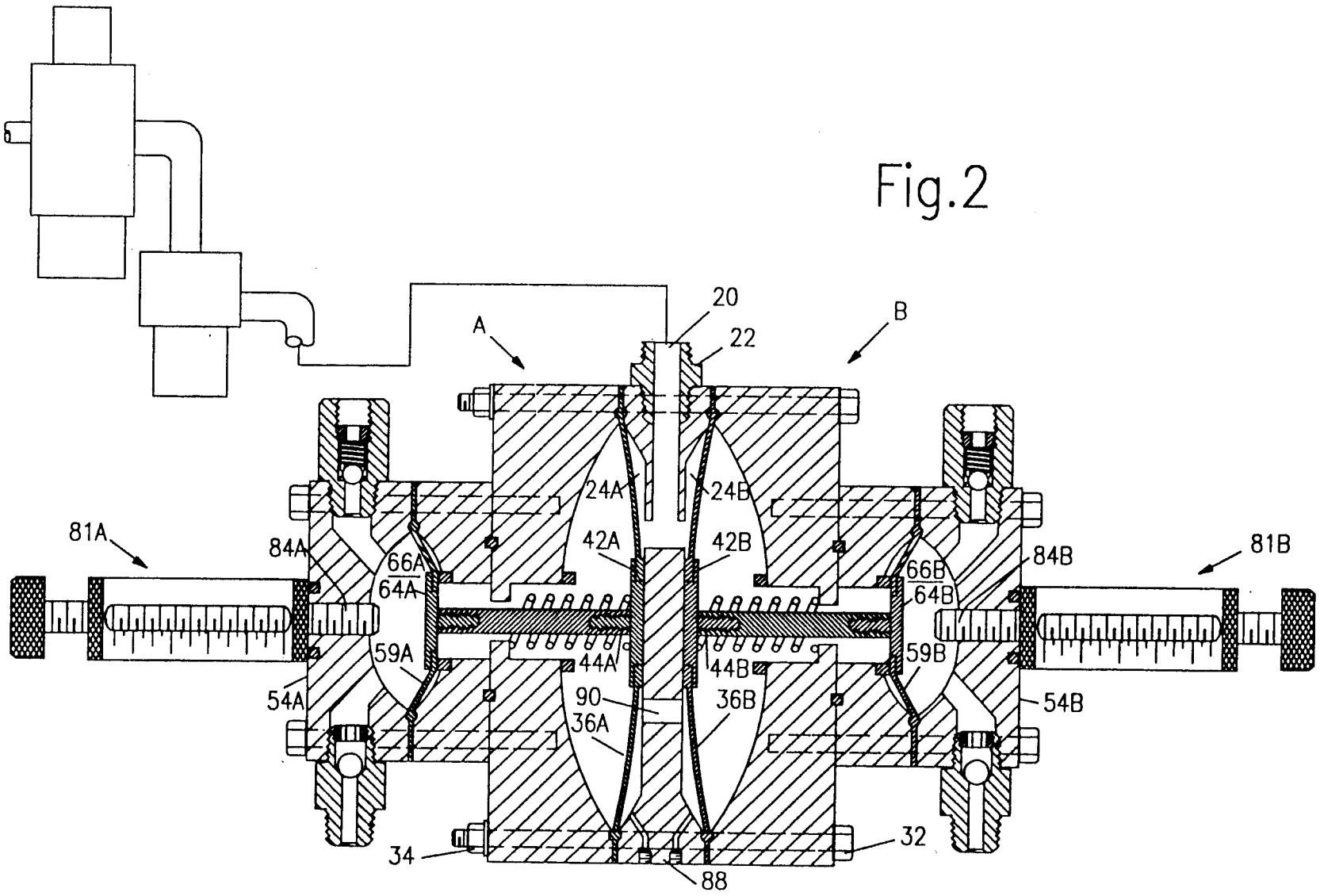
FIG. 2 is a cross-sectional view of a dual multi-diaphragm pump, with each pump of a design in accordance with the present invention, that share a single head wall and pressurization intake, with the respective pressurizing diaphragms shown in a fully retracted and unpressurized position.
Figure 3:
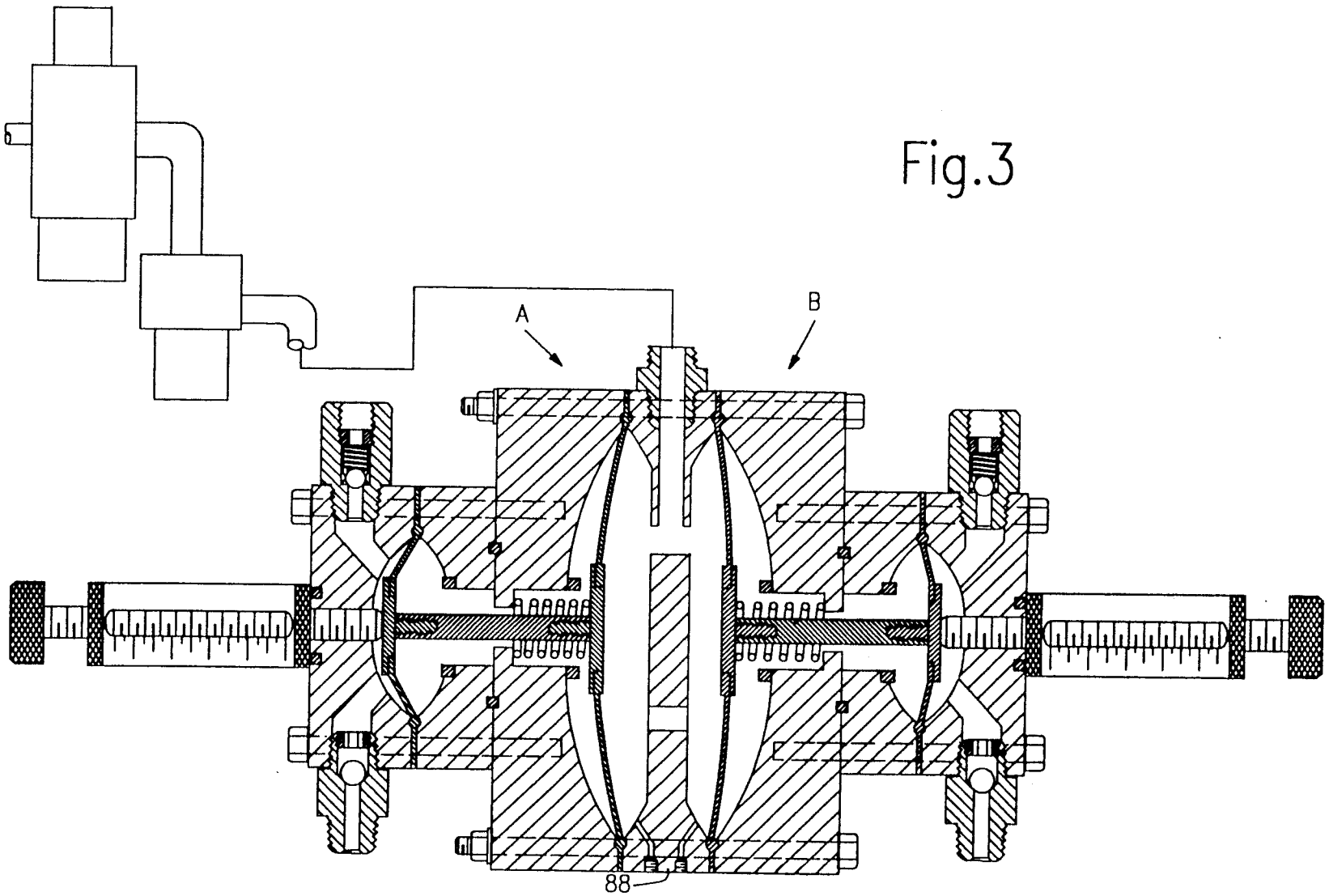
FIG. 3 is the same cross-sectional representation as illustrated in FIG. 2, but with the respective pressurizing diaphragms shown in a fully compressed and pressurized position.

Referring now to FIGS. 2 and 3, a pair of multi-diaphragm pumps A and B, each embodying the present invention, are substantially identical to the above-described pump although pumps A and B share a common head wall portion 88 as each pump's respective upper motor chamber housing plate. The pumps also share a single source of intermittent pressurization supplied through hollow bore 20 of inlet nipple 22. Such a configuration allows the operation of both pumps from a single controller. Because both pumps are pressurized by the same pulse of pressurized fluid, the pumps will operate with simultaneous pumping and exhaust strokes. The components of pumps A and B that are substantially the same as previously described will be identified by the same numeral with the suffix A or B, respectively, but all the components will not be redescribed.

One or more pressure equalization passages 90 is provided between motor chambers 24A and 24B of pumps A and B, respectively, to ensure uniform application of the force supplied by the pressurized fluid against pressurizing diaphragms 36A and 36B, respectively. Notably, however, pumps A and B are each provided with a separate stroke adjuster 81A and 81B, respectively. Thus, although both pumps are pressurized by the same source of intermittent pressurization and at the same cyclical rate, the volumetric output of transient fluid being pumped is independently adjustable in each.

As configured, pumps A and B have stroke adjusters 81A and 81B, respectively, with stroke adjuster rods 84A and 84B extending into pumping chambers 66A and 66B, respectively. Specifically, stroke adjuster rods 84A and 84B access lower pumping chamber housing plates 54A and 54B, respectively, in an axial relationship to the middle portions 64A and 64B, respectively, of the respective pumping diaphragms. The center portions 64A and 64B of pumping diaphragms 59A and 59B, respectively, are engaged by the respective stroke adjuster rods, thereby limiting the respective pumping strokes of pumps A and B, accordingly. Thus, the volumetric output of the respective pump is varied by extending, or retracting, the respective stroke adjuster rod into the respective pumping chamber. After a full exhaust stroke, middle portions 42A and 42B of pressurizing diaphragms 36A and 36B, respectively, engage opposite facing sides of shared head wall 88.

As can be seen, FIG. 2 illustrates pumps A and B in a fully depressurized or expanded mode, i.e., having just completed an exhaust stroke, wherein the center portions 42A and 42B of the respective pressurizing diaphragms abut against opposite sides of shared head wall 88. In FIG. 3, the pumps are shown in a fully pressurized or compressed mode, i.e., having just completed a pumping stroke, wherein the center portions 64A and 64B of the respective pumping diaphragms abut against the respective stroke adjuster rods 84A and 84B. As shown, the volume of transient fluid pumped by pump A is greater than by pump B.

Referring now to FIGS. 4–7, in lieu of the externally extending calibrated stroke adjuster rod configuration illustrated in FIGS. 2–3 for engaging the two remote pumping diaphrams 59A and 59B, a pair of pivotable cams 92A and 92B may be utilized to accurately set the stroke length of the pressurizing diaphragm 36A and 36B of each pump A and B in a dual pump configuration, as follows:

Cams 92A and 92B are provided in an opening 89 of shared head wall 88 such that said cams act as a "stop" against center portions 42A and 42B, respectively, of pressurizing diaphragms 36A and 36B, respectively. By using spacing tubes 98A and 98B, respectively, of different lengths and reversely positioned, the cams are located in an off-set manner with respect to each other. In a fully retracted position, (See FIG. 5), each cam allows the maximum stroke length, wherein said center portions 42A and 42B, respectively, abut against opposite sides of shared head wall 88 after a full exhaust stroke. Because the cams are adjusted in a mutually exclusive manner, each may be positioned to extend a different amount into the respective motor chamber, (See FIG. 6), thereby resulting in varying pump outputs, while said pumps are pressurized from an identical pneumatic pulse supply and at the same rate.

Figure 4:
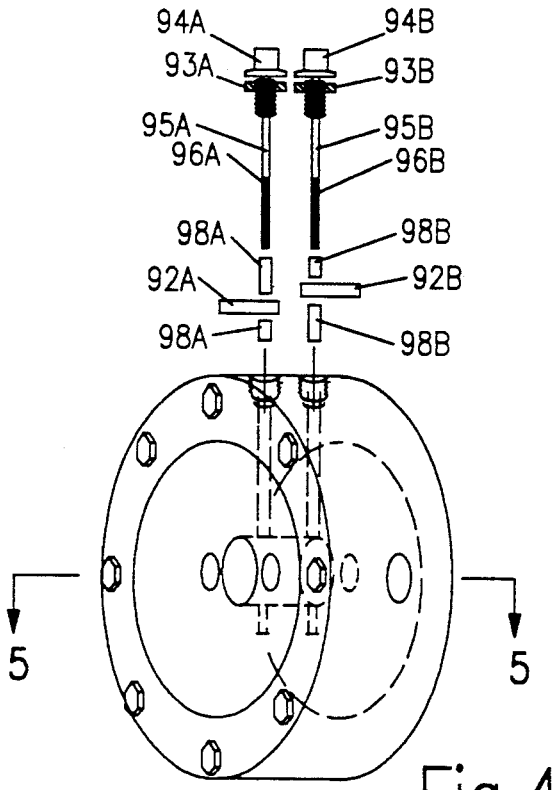
FIG. 4 is an exploded perspective of a stroke adjuster cam configuration as utilized in a dual pump configuration.
Figure 5:
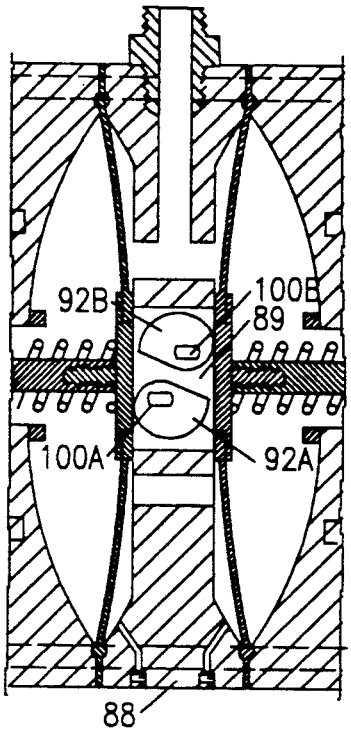
FIG. 5 is a cross-sectional view taken along lines 5—5 of FIG. 4.
Figure 6:
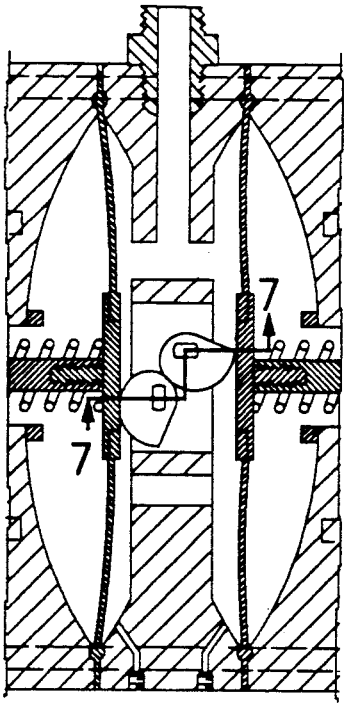
FIG. 6 is the same cross-sectional representation illustrated in FIG. 5, but with the stroke adjuster cams set in different positions.
Figure 7:
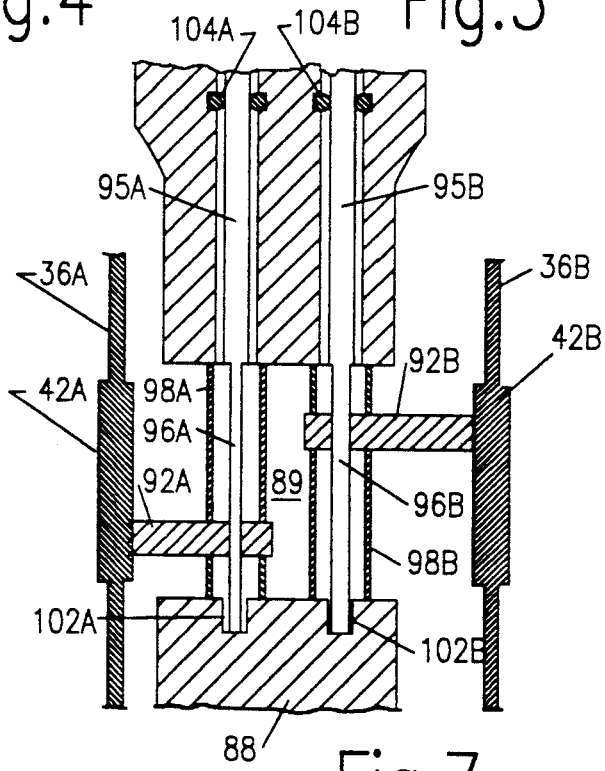
FIG. 7 is an enlarged cross-sectional view taken along lines 7—7 of FIG. 6.
Figure 8:
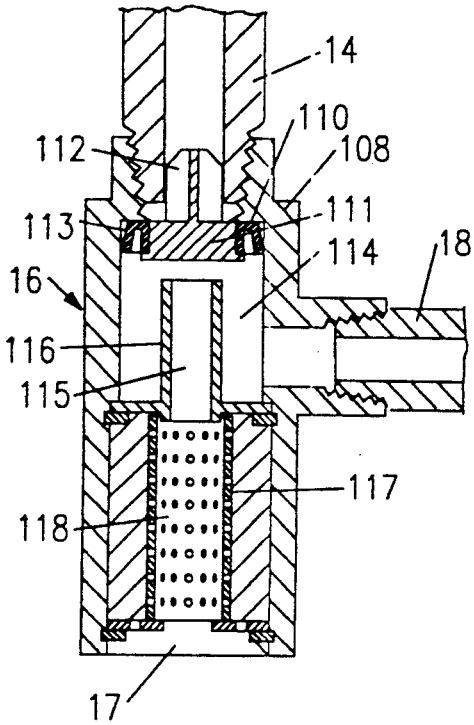
FIG. 8 is a cross-sectional view of a quick exhaust valve for use with a single mode pressure supply controller or relay, shown in an exhaust position.
Figure 9:
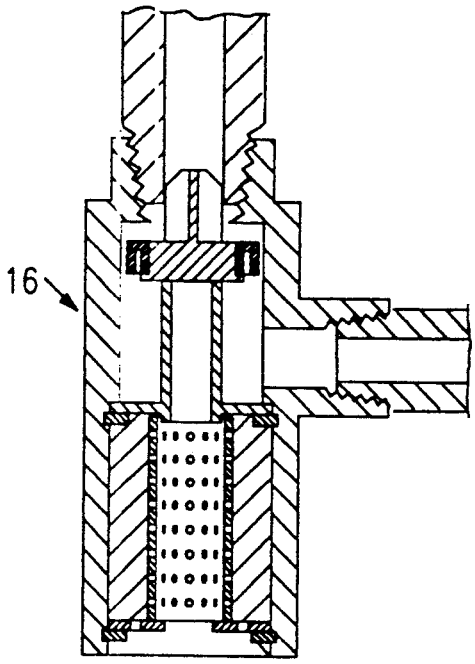
FIG. 9 is the same cross-sectional representation illustrated in FIG. 8, but with the quick exhaust disk valve shown in an intake or supply position.

As best seen in FIGS. 4 and 7, cams 92A and 92B are secured in position by a pair of actuating cam shafts 95A and 95B, respectively. Cam shafts 95A and 95B have at one end a portion having a substantially rectangular cross-section 96A and 96B, respectively. Substantially rectangular portions 96A and 96B of said shafts extend through opening 89, wherein said shafts pass through likewise substantially rectangularly shaped openings 100A and 100B, respectively, in cams 92A and 92B, respectively. Shafts 95A and 95B each have another end which threadedly engages and extends outwardly through the shared head wall 88. Adjustment knobs 94A and 94B are fixed to the ends of shafts 95A and 95B, respectively, for adjusting the shafts and cams. Jam nuts 93A and 93B are threaded on the end of shafts 96A and 96B, respectively, and are tightened against the exterior surface of head wall 88 to lock the positions of shafts 95A and 95B. Rotation of shafts 95A and 95B causes actuation of said cams 92A and 92B, respectively, so as to cause each to extend into, or retract from, the respective motor chamber. At the opening 89 in shared head wall 88 where the cams are located, a pair of spacer tubes 98A and 98B are provided to position said cams in a non-interfering manner. Tubes 98A and 98B also house shafts 95A and 95B, respectively, said tubes each extending fully across opening 89. O-rings 104A and 104B are provided around shafts 95A and 95B, respectively, within shared head wall 88, to seal the respective motor chambers and prevent escape of the pressurized fluid. A pair of bores 102A and 102B are located in wall 88 to rotatably seat the ends of cams shafts 95A and 95B, respectively, which extend through said cams.

As can be seen, the rotation of adjustment knob 94A and 94B, will result in the movement of cam 92A or 92B, respectively, thereby either extending said cams into, or retracting said cams from, the respective motor chambers. The adjustment knobs can be calibrated to allow the user to accurately set the volumetric output of each pump in the dual pump configuration.

Referring now to FIGS. 8-12, in order to rapidly exhaust the motor chamber and, thereby, effect a quick return of the pressurizing diaphragm during an exhaust stroke to allow for immediate repressurization of said motor chamber, a single mode, quick exhaust valve 16 is provided. The valve 16 comprises a valve housing 108 having two threaded attachment openings and an exhaust port 17. The controller output feed line 14 is threadedly attached at one opening, such that the intermittent pulses of pressurized fluid enter said valve housing. The second opening of housing 108 is threadedly attached to pump intake line 18, which communicates with the motor chamber of the pump, as described above.

Figure 10:
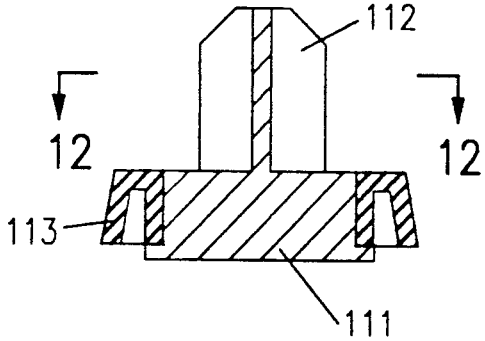
FIG. 10 is a cross-sectional view of a first embodiment of the quick exhaust valve disk used in the valve illustrated in FIGS. 8 and 9.
Figure 11:
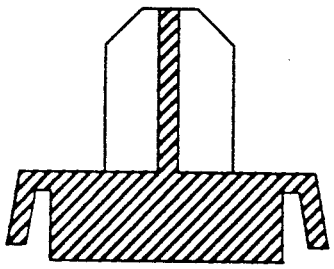
FIG. 11 is a cross-sectional view of a second embodiment of the disk shown in FIG. 10.
Figure 12:
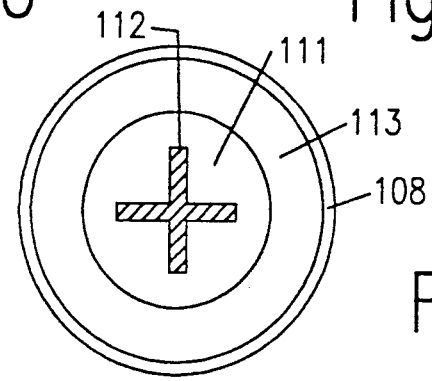
FIG. 12 is a top view of the disk taken along lines 12—12 of FIG. 10.

A valve disk 111 occupies a chamber 114 within valve housing 108 and has a first side adjacent inlet tube 14, and a second side above intake line 18. Disk 111 is snugly contained within valve housing 108 and has a cup-shaped seal 113 about its circumference, to effect an airtight seal between the exterior edge of said disk and the interior wall of said valve housing. Disk 111 also is provided with a cross-shaped stem portion 112 which extends from the first side of the disk adjacent feed line 14 into a portion of housing 108 having a smaller cross section than said disk and cup-shaped seal. Stem portion 112 thereby guides the vertical movement and restricts lateral movement of disk 111. As can be seen in FIGS. 10 and 11, the cup-shaped seal 113 may comprise a separately molded component from the disk 111 and stem portion 112, (FIG. 10), or they may be molded as a single component (FIG. 11).

A sleeve 116 having an exhaust cavity 115 connects the exhaust port 17 with chamber 114. Sleeve 116 extends into chamber 114 in an axial relationship to that side of disk 111 above intake line 18. Valve housing 108 has an annular shoulder portion proximate the opening attached to feed line 14, said shoulder having a smaller cross-section than disk 111 and cup-shaped seal 113, but a larger cross-section than stem portion 112. Thus, as configured, disk 111 may be moved "vertically" through chamber 114, thereby abutting sleeve 116 on one end and abutting the shoulder portion of the valve housing on the other end.

During a motor chamber pressurization phase (See FIG. 9), pressurized fluid passing through line 14 from the pneumatic controller 12 moves disk 111 away from the shoulder portion of valve housing 108 and downwardly in chamber 114. The disk abuts against sleeve 116, thereby sealing exhaust cavity 115 and preventing any pressurized fluid from exiting. Because the entire surface area of the first side of the disk is exposed to the pressurized fluid, the disk will remain seated against sleeve 116, as only atmosphere from exhaust cavity 115 presses against the second side of the disk. In this mode, the outward edge of cup-shaped seal 113 bends inward, thereby allowing the passage of the pressurized fluid around the outer circumference of the disk seal and into line 18.

During depressurization of the motor chamber (See FIG. 8), the fluid is exhausted from line 14 by controller 12 to allow the fluid to be exhausted from the motor chamber back through line 18 and into relay chamber 114. Disk 111 breaks its seal with sleeve 116 and is pressed against the shoulder portion of valve housing 108, allowing the fluid to escape through exhaust cavity 115 of sleeve 116 and out exhaust port 17, thereby accomplishing the rapid evacuation of pressurizing chamber 24. The outer edge of cup-shaped seal 113 is pressed by the exiting fluid against the interior wall valve housing 108, effecting a seal against said interior wall and preventing the fluid from exiting back through feed line 14.

A silencing mechanism 18 may be provided to diffuse the sound of the rapidly expanding exhaust fluid. In some embodiments, such as that shown in FIGS. 8-9, the silencer may be comprised of a steel tube axially connected to sleeve 116, having a plurality of small holes and surrounded by a layer of fibrous, noise absorbing materials 117.

Figure 13:
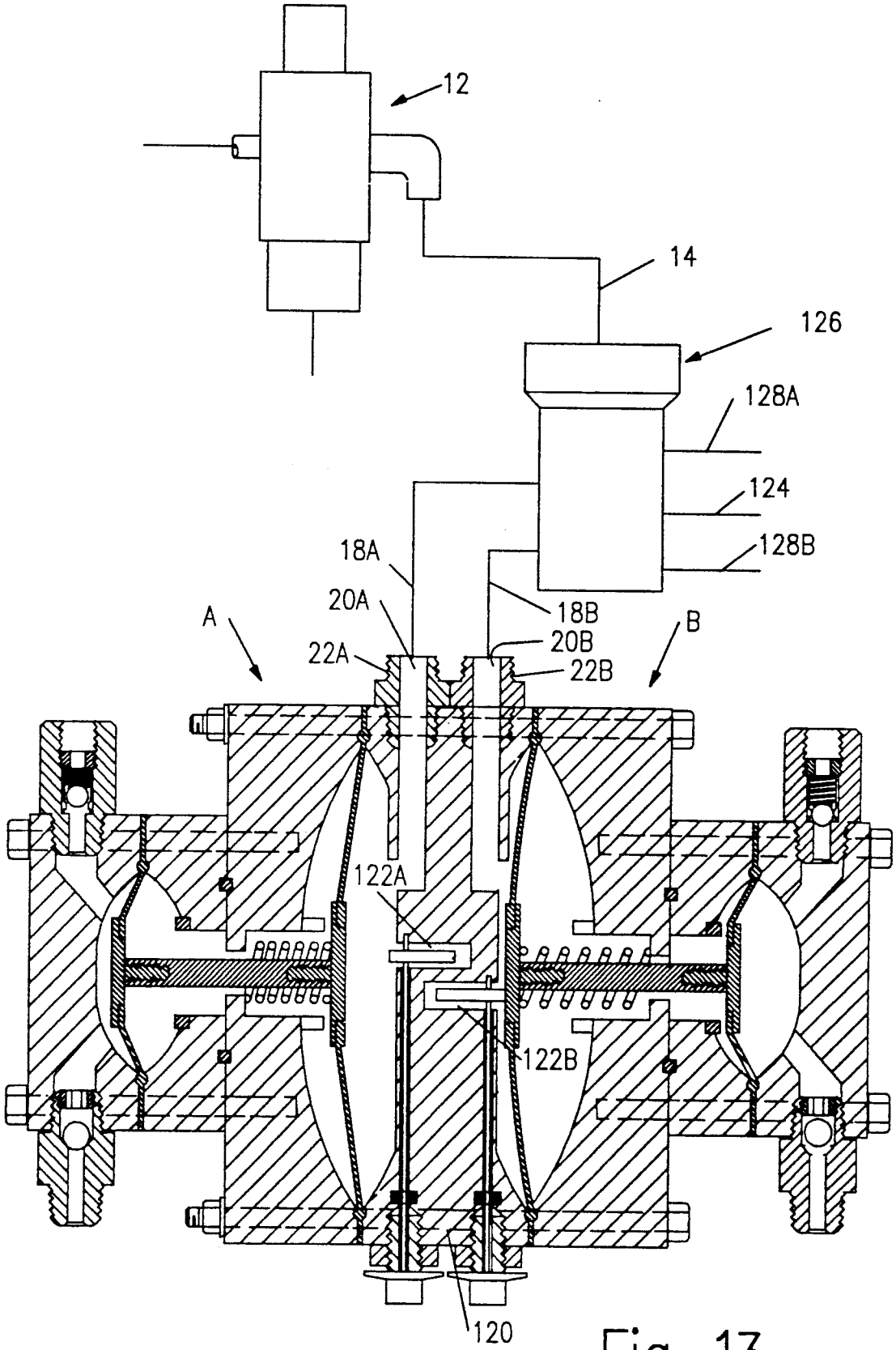
FIG. 13 is a cross-sectional view of a dual multi-diaphragm pump, with each pump of a design in accordance with the present invention, that share a single head wall, but have separate pressurization intakes.

Referring now to FIG. 13, there is shown a second embodiment of a dual pump configuration, wherein each pump is designed in accordance with the present invention and the pumps share a common head wall portion of their respective upper motor chamber housing plates. However, this second embodiment discloses the use of separate intake supplies of pressurized fluid for pressurizing each pump. Specifically, a shared head wall portion 120 of the upper motor chamber housing plates of respective pumps A and B completely isolates the respective motor chambers. Each pump is pressurized by an independent source of pressurized fluid supplied through separate ports 20A and 20B, respectively, of separate connectors 22A and 22B, respectively, of separate connectors 22A and 22B, respectively, from separate supply lines 18A and 18B, respectively.

In some embodiments, the operation of pump A may be completely independent of the operation of pump B; e.g., pressurized fluid pulsed through intake line 18A may be supplied from a differently controlled source and may have different characteristics, such as pressure and timing, than that pulsed through line 18B. In fact, the pressurization fluid used in the two pumps may be derived from completely different substances, e.g., natural gas in line 18A and air in line 18B.

In the embodiment illustrated in FIG. 13, however, lines 18A and 18B are both supplied from a multi-mode relay 126, which in turn is "piloted" from a single pneumatic controller 12. While utilizing this method for the simultaneous operation of two pumps is useful for achieving a continuous supply of transient fluid being pumped, (as described herein), it is not intended to limit the possible alternative methods for independently operating a dual pump configuration embodying the present invention. As configured, pumps A and B act as a single pump operation having two sets of diaphragm pairs, each pair being alternately driven to achieve a substantially constant output, as follows:

Intermittent pulses of pressurization from controller 12 provide the timing for relay 126 and the relay 126 is connected to a source of constant pressurization 124, dual pump supply lines 18A and 18B, and corresponding dual pump exhaust ports 128A and 128B, respectively. In a manner described herein, relay 126 alternately supplies and discharges pressurized fluid through lines 18A and 18B. As such, pumps A and B have alternate pumping and exhaust strokes, thereby providing a nearly constant output of the transient fluid being pumped. A pair of cam stroke adjusters are provided in slots 122A and 122B, respectively, of shared head wall 88 to allow the pump operator to independently vary the output of each pump.

Figure 14:
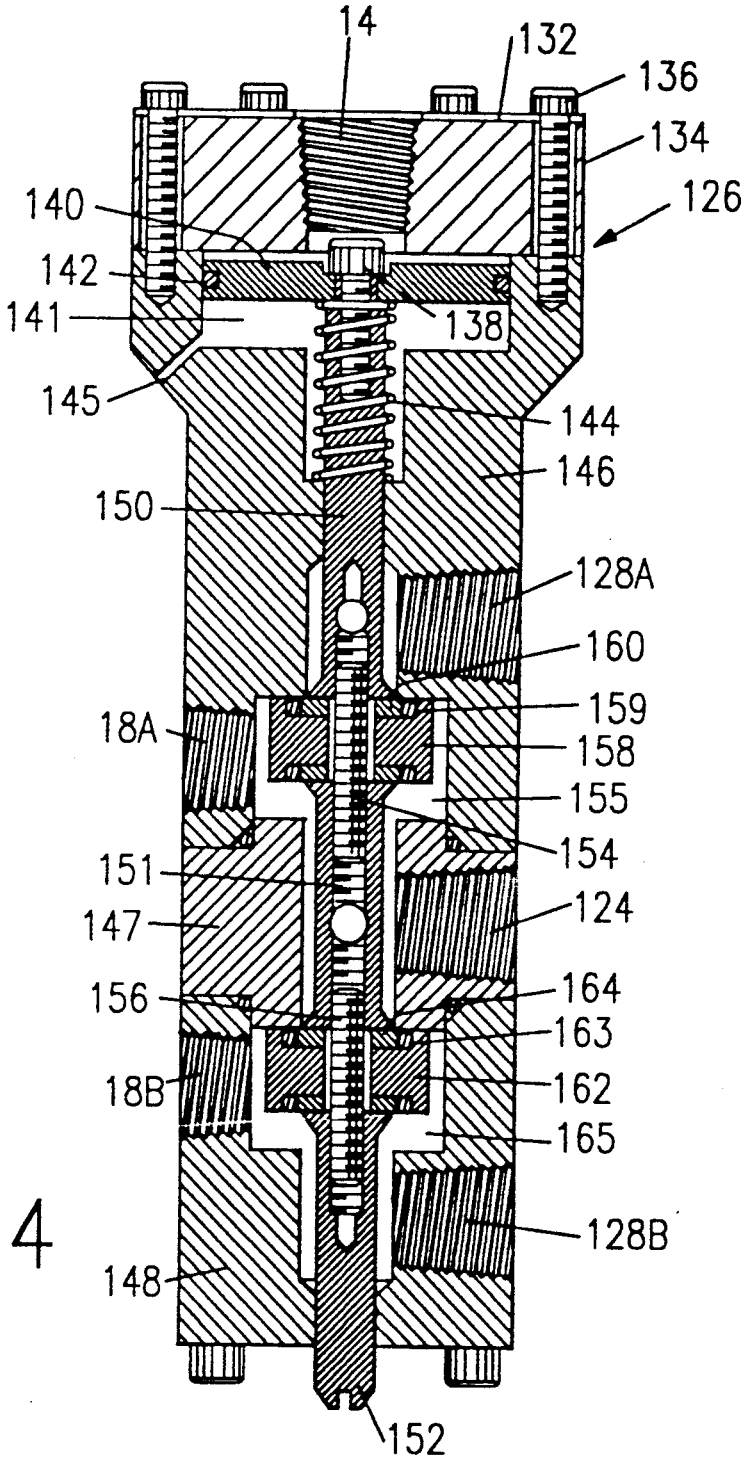
FIG. 14 is a cross-sectional view of a multi-mode pressure supply relay of a type for use with the dual multi-diaphragm pump of FIG. 13.

Referring now to FIG. 14, the components of relay 126 are illustrated to facilitate an understanding of its operation. Relay 126 comprises an upper body section 146, middle body section 147 and lower body section 148. A top cap 134 housing a threaded inlet for pilot feed line 14 is secured by a data plate 132 and a plurality of top cap screws 136 into upper body section 146. Located at one side of the relay are three threaded access ports: between the upper and middle body sections is a first exhaust port 128A; between the middle and lower body sections is a second exhaust port 128B; and approximately an equal distance between said first and second exhaust ports is a pressurization supply port 124. Supply port 124 is connected to a constant source of pressurized fluid, (not shown). Located on an opposite side of said exhaust and pressure supply ports are two threaded inlet ports for pump supply lines 18A and 18B, respectively, said intake line port 18A located vertically between exhaust port 128A and supply port 124, and said intake line port 18B located vertically between exhaust port 128B and said supply port.

A pair of disk-shaped popped pistons 158 and 162, each having a substantially flat "upper" surface and a substantially flat "lower" surface, occupy a pair of cavities 155 and 165, respectively, within relay 126. Popped 158 is equipped on both sides with an o-ring seal 159 held in place by an o-ring retainer 160. Popped 162 is likewise equipped on both sides with an o-ring seal 163 held in place by an o-ring retainer 164. Cavities 155 and 165 are situated proximate inlets ports 18A and 18B, respectively, said cavity 155 having access to pressurization supply port 124 and exhaust port 128A on alternate sides of popped 158, and said cavity 165 having access to pressurization supply port 124 and exhaust port 128B on alternate sides of popped 162. Popped 158 may be displaced vertically within cavity 155 and seated against vertically opposing sides of said cavity, such that the o-ring seals 159 can alternately form a seal on either of said opposing sides, thereby preventing access to pressurization source port 124 or exhaust port 128A, respectively. Popped 162 may be displaced vertically within cavity 165 and seated against vertically opposing sides of said cavity, such that the o-ring seals 163 can alternately form a seal on either of said opposing sides, thereby preventing access to pressurization source port 124 or exhaust port 128B respectively.

A plurality of popped stems are connected axially and extend through the center of relay 126, including an upper popped stem 150, middle popped stem 151 and lower popped stem 152, said stems each having an "upper" and "lower" end and each extending proximate the upper, middle and lower body sections, respectively, of said relay. A first popped stem connector bolt 154 rigidly affixes the lower end of the upper stem 150 axially to the upper end of middle stem 151. A second popped stem connector bolt 156 rigidly affixes the lower end of middle stem 151 axially to the upper end of lower stem 152.

Popped piston 158 is secured between the upper and middle popped stems, respectively, in that the upper surface of popped 158 is attached to the lower end of stem 150 and the lower surface of popped 158 is attached to the upper end of stem 151. The circumference of O-rings 159 on said upper and lower surfaces of popped 158 extend around the respective attachment points of said stems. Likewise, Popped piston 162 is secured between the middle and lower popped stems, respectively, in that the upper surface of popped 162 is attached to the lower end of stem 151 and the lower surface of popped 162 is attached to the upper end of stem 152. The circumference of O-rings 163 on said upper and lower surfaces of popped 162 extend around the respective attachment points of said stems.

The upper end of upper popped stem 150 is secured to a piston 140 by a piston lock screw 138. Piston 140 occupies a piston cavity 141 in upper body section 146 and has an o-ring 142 about its circumference to effect a seal with the interior walls of said cavity. Cavity 141 has a lower portion for accommodating a compression spring 144, said spring being coiled around upper popped stem 150 and retained between piston 140 and an interior surface of upper body section 146 within cavity 141 to resiliently urged the piston 140 in an upward direction. Piston 140 has a first side adjacent to feed line 14, said first side is exposed to intermittent pressurization pulses from said feed line from the controller 12 for causing the "inward" displacement of said piston. A pressure bleed opening 145 is provided for cavity 141 on a reverse side of piston 140, so that the force applied by the interim feed pressurization against the first side of said piston meets minimal resistance from pressure on said reverse side.

As can be seen, controller 12 pilots relay 126 as follows:

The controller 12 intermittently pulses pressurized fluid through feed line 14, which causes the "downward" displacement of piston 140 through cavity 141. The displacement of piston 140 causes the corresponding displacement of the upper, middle and lower popped stems, respectively, said stems being fixedly connected in a axial relationship to each other and to said piston. Accordingly, popped pistons 158 and 162 are displaced within cavities 155 and 165, respectively, with O-rings 159 and 163, respectively, forming tight seals against interior surfaces of the middle and lower body sections within said cavities.

When piston 140 is fully compressed, popped piston 158 seals off intake line 18A from communication with pressurization supply port 124, while exposing it to exhaust port 128A. At the same time, popped piston 162 seals off intake line 18B from communication with exhaust port 128B, while exposing it to pressurization supply port 124. Thus, when feed line 14 cycles pressurization to relay 126, said relay causes pump A to undergo an exhaust stroke and pump B to undergo a simultaneous pumping stroke.

The full compression of piston 140 also results in the compression of spring 144. When the controller 12 cycles to a depressurization phase, feed line 14 exhausts the pressurized fluid and compressed spring 144 causes piston 140 to be "upwardly" displaced through cavity 141, thereby pulling popped pistons 158 and 162, respectively, in the same direction.

When piston 140 is fully elevated, popped piston 158 seals off intake line 18A from communication with exhaust port 128A, while exposing it to pressurization supply port 124. At the same time, popped piston 162 seals off intake line 18B from communication with pressurization supply port 124, while exposing it to exhaust port 128B. Thus, during depressurization of feed line 14, relay 126 causes pump A to undergo a pumping stroke and pump B to undergo a simultaneous exhaust stroke.

Because either pump A or pump B is undergoing a pumping stroke at a given instant, a substantially constant output of the transient fluid is achieved.

While embodiments and applications of this invention have been shown and described, it would be apparent to those skilled in the art that many more modifications are possible without departing from the inventive concepts herein. The described embodiments of the invention are only considered to be preferred and illustrative of the inventive concepts; and the scope of the invention is not to be restricted to such embodiments. Various and numerous other arrangements may be devised by one skilled in the art without departing from the spirit and scope of the invention.

For example, although the illustrated embodiments of the invention include pneumatically operated, pumps, other power mechanisms may be used without departing from the inventive concept of using a sealed pressurizing diaphragm to operate a sealed diaphragm. The present invention is equally suitable to be utilized in a pump operating by electronic means, such as a cyclically operated solenoid valve. Further, while the invention is directed to use in high pressure injection pumps, it may be equally useful for any type of displacement pump application, wherein eliminating seals is desirable, or wherein a diaphragm is exposed to a significant pressure differentials. Moreover, while pumps A and B are configured in a back-to-back design in the embodiments shown in FIGS. 2–3 and 13, other configurations, (e.g., side-by-side), are possible utilizing the present inventive concept, regardless of whether each pair of diaphragms is driven by a single pressurization source or by an independent source. There is no reason to limit the quantity of diaphragm pairs arranged in a single pump operation to one or two. The number and arrangement of diaphragm pairings possible are plentiful. The invention, therefore, is not to be restricted except in the spirit of the appended claims.

What is claimed is:

1. A multi-diaphragm metering pump, comprising:

first and second diaphragms mounted in a body in substantially parallel relationship and having adjacent sides and remote sides, wherein an open fluid communication path is provided within said body between said adjacent sides;

means for connecting said adjacent sides for movement of the diaphragms substantially in unison;

means for pressurizing the remote side of the first diaphragm for causing movement of the first diaphragm; and means in said body for communicating a transient fluid to be pumped to the remote side of the second diaphragm for pumping of said transient fluid upon said movement of the first and second diaphragms in unison.

2. A multi-diaphragm metering pump, comprising:

a pump body having first and second chambers, said chambers having adjacent openings providing means to freely communicate a fluid between the two chambers;

a first diaphragm mounted in the first chamber and forming a sealed wall within said first chamber;

a second diaphragm mounted in the second chamber and forming a sealed wall within said second chamber, such that a sealed enclosure is formed between said first and second diaphragms within said pump body; and a stem rigidly connecting said first and second diaphragms within said sealed enclosure, such that movement of said first diaphragm will cause movement of said second diaphragm substantially in unison.

3. A multi-diaphragm metering pump operated by a pressurized fluid for pumping a transient fluid, comprising:

a pump body having a motor chamber and a pumping chamber, said chambers having adjacent openings providing means to freely communicate a fluid between the two chambers;

a pressurizing diaphragm and a pumping diaphragm mounted in substantially parallel relationship in said motor and pumping chambers, respectively, said diaphragms each having an adjacent side facing the other diaphragm and a remote side facing away from the other diaphragm and each forming a sealed wall within said motor and pumping chambers, respectively, wherein a sealed enclosure is formed between said adjacent sides including said adjacent openings;

a diaphragm stem rigidly connecting the adjacent sides of the pressurizing and pumping diaphragms within said sealed enclosure;

means for cyclically providing the pressurized fluid to the motor chamber on the remote side of the pressurizing diaphragm for causing cyclical movement of said pressurizing and pumping diaphragms substantially in unison, wherein the fluid pressure within said sealed enclosure increases during movement of the pressurizing diaphragm in the pumping direction, thereby exerting a force across the adjacent side of the pumping diaphragm in the pumping direction independent of that caused by movement of said diaphragm stem; and means for controlled intake and discharge of the transient fluid in the pumping chamber on the remote side of the pumping diaphragm for pumping said transient fluid by said cyclical movement.

4. The pump of claim 3, further comprising means for adjustably limiting the movement of the pressurizing and pumping diaphragms in one direction for adjusting the amount of transient fluid pumped by each cyclical movement.

5. The pump of claim 4, wherein said adjustable limiting means includes an adjustable rod mounted on said body for engaging the remote side of the pressurizing diaphragm.

6. The pump configuration of claim 3, wherein said means for controlled intake and discharge of the transient fluid includes an intake check valve connected to the pumping chamber for allowing the transient fluid to be drawn into said pumping chamber, and an discharge check valve connected to the pumping chamber for allowing the transient fluid to be pumped out of said pumping chamber.

7. The pump of claim 3, wherein said means for cyclically providing the pressurized fluid includes a controller means for cyclically supplying the pressurized fluid at controlled intervals and exhausting the pressurized fluid after the diaphragms have completed their pumping movement.

8. The pump of claim 7, wherein said controller means includes a relay for supplying the pressurized fluid.

9. The pump of claim 7, wherein a quick release valve is provided between the controller means and the motor chamber for rapidly exhausting the pressurized fluid and allowing immediate repressurizing of the motor chamber.

10. The pump of claim 7, wherein said controller means includes a solenoid operated valve and means for cyclically operating said solenoid operated valve for cyclically supplying the pressurized fluid.

11. The pump of claim 3, wherein said pressurizing diaphragm is larger than said pumping diaphragm for pumping the transient fluid at a pressure higher than the pressure of the pressurized fluid.

12. The pump of claim 3, wherein a stop means is provided in said body for engaging and stopping the movement of the pressurizing diaphragm in the pumping direction, stop means and pressurizing diaphragm engaging in a manner for allowing fluid to pass therebetween.

13. A multi-diaphragm metering pump configuration, comprising:

two pair of diaphragms mounted in a body, each pair of diaphragms having a pressurizing diaphragm and a pumping diaphragm positioned substantially parallel and connected for movement in unison;

each pressurizing diaphragm forming a sealed wall within said body and having a pressurizing side remote from the pumping diaphragm to which that pressurizing diaphragm is connected;

each pumping diaphragm forming a sealed wall within said body and having a pumping side remote from the pressurizing diaphragm to which that pumping diaphragm is connected;

each pair of diaphragms having an open fluid communication path provided between adjacent sides of the respective pressurizing and pumping diaphragm, wherein a sealed enclosure is formed between said adjacent sides within said body;

means for controlled intake and discharge of a transient fluid to be pumped to and from, respectively, said remote side of each pumping diaphragm; and means for cyclically providing a pressurized fluid to said pressurizing side of each pressurizing diaphragm to cause said movement in unison of each pair of diaphragms for causing pumping of the transient fluid by each said pumping diaphragm, wherein the fluid pressure within the sealed enclosure formed by each pair of diaphragms increases during the movement of the respective pressurizing diaphragm in the pumping direction, thereby exerting a force on the respective pumping diaphragm.

14. The pump configuration of claim 13, wherein each said pressurizing side forms a wall portion of a motor chamber, the two said motor chambers being adjacent and sharing a single said means for cyclically providing pressurized fluid to both respective pressurizing sides.

15. The pump configuration of claims 13 or 14, wherein means are provided for adjustably limiting said movement in unison of at least one said pair of diaphragms.

16. The pump configuration of claim 15, wherein said adjustable limiting means includes at least one adjustable rod mounted on said body for engaging the pumping side of at least one pumping diaphragm.

17. The pump configuration of claim 15, wherein said adjustable limiting means includes at least one pivotable cam mounted on said body for engaging the pressurizing side of at least one pressurizing diaphragm to stop the movement of the pressurizing diaphragm in the direction of the cam and, in turn, stop the pumping intake movement of the respective pumping diaphragm.

18. The pump configuration of claims 13 or 14, wherein said means for controlled intake and discharge of the transient fluid includes a pumping chamber in the body on the pumping side of the pumping diaphragm, an intake check valve connected to said pumping chamber for allowing the transient fluid to be drawn into said pumping chamber, and an discharge check valve connected to said pumping chamber for allowing the transient fluid to be pumped out of said pumping chamber.

19. The pump configuration of claims 13 or 14, wherein said means for cyclically providing the pressurized fluid includes a controller means for cyclically supplying and exhausting the pressurized fluid at controlled intervals.

20. The pump configuration of claim 19, wherein said controller means includes a relay for alternately supplying the pressurized fluid to each said pressurizing side of said pressurizing diaphragms, respectively.

21. The pump configuration of claim 19, wherein a quick exhaust mechanism is provided for alternately exhausting the pressurized fluid from each said pressurizing side of said pressurizing diaphragms, respectively.

22. The pump configuration of claim 19, wherein said controller means includes a solenoid operated valve and means for cyclically operating said solenoid operated valve for cyclically supplying the pressurized fluid.

23. The pump configuration of claims 13 or 14, wherein said pressurizing diaphragms are larger than said pumping diaphragms for pumping the transient fluid at a pressure higher than the pressure of the pressurized fluid.

24. The pump configuration of claim 13, wherein a stop means is provided in said body for engaging and stopping the movement of each respective pressurizing diaphragm in the pumping direction, said stop means and pressurizing diaphragms engaging in a manner for allowing fluid to pass therebetween.

25. A multi-diaphragm metering pump, comprising;

first and second diaphragms mounted in a body in substantially parallel relationship and having adjacent sides and remote sides;

a stem rigidly connecting said adjacent sides for movement of said first and second diaphragms in substantial unison, said stem being spaced from said body without fluid seals between said stem and said body;

a first chamber formed on the remote side of said first diaphragm for being cyclically pressurized and depressurized for causing movement of said first diaphragm; and a second chamber formed on the remote side of said second diaphragm for pumping a transient fluid to and from said second chamber upon said movement of said first diaphragm.

26. A multi-diaphragm metering pump, comprising:

a pump body having first and second chambers, said chambers having adjacent openings providing means to freely communicate a fluid between the two chambers;

a first diaphragm mounted in the first chamber and forming a sealed wall within said first chamber;

a second diaphragm mounted in the second chamber and forming a sealed wall within said second chamber, such that a sealed enclosure is formed between said first and second diaphragms within said pump body; and means provided in said enclosure between said first and second diaphragms for causing movement of said second diaphragm upon movement of said first diaphragm toward said second diaphragm.

27. A multi-diaphragm metering pump operated by a pressurized fluid for pumping a transient fluid, comprising:

a pump body having a motor chamber and a pumping chamber, said chambers having adjacent openings providing means to freely communicate a fluid between the two chambers;

a pressurizing diaphragm and a pumping diaphragm mounted in said motor and pumping chambers, respectively, said diaphragms each having an adjacent side facing the other diaphragm and a remote side facing away from the other diaphragm and each forming a sealed wall within said motor and pumping chambers, respectively, wherein a sealed enclosure is formed between said adjacent sides including said adjacent openings;

means provided in said sealed enclosure between said pressurizing and pumping diaphragms for causing movement of said pumping diaphragm upon movement of said pressurizing diaphragm toward said pumping diaphragm;

means for cyclically providing the pressurized fluid to the motor chamber on the remote side of the pressurizing diaphragm for causing cyclical movement of said pressurizing and pumping diaphragms, wherein the fluid pressure within said sealed enclosure increases during movement of the pressurizing diaphragm in the pumping direction, thereby exerting a force across the adjacent side of the pumping diaphragm in the pumping direction; and;

means for controlled intake and discharge of the transient fluid in the pumping chamber on the remote side of the pumping diaphragm for pumping said transient fluid by said cyclical movement.

28. A multi-diaphragm metering pump configuration, comprising:

two pair of diaphragms mounted in a body, each pair of diaphragms having a pressurizing diaphragm and a pumping diaphragm;

each pressurizing diaphragm forming a sealed wall within said body and having a pressurizing side remote from the pumping diaphragm of said pair of diaphragms;

each pumping diaphragm forming a sealed wall within said body and having a pumping side remote from the pressurizing diaphragm of said pair of diaphragms;

each pair of diaphragms having an open fluid communication path provided between adjacent sides of the respective pressurizing and pumping diaphragm, wherein a sealed enclosure is formed between said adjacent side within said body;

means provided in said sealed enclosure between each pair of said diaphragms for causing movement of said pumping diaphragm upon movement of said pressurizing diaphragm toward said pumping diaphragm of each pair of diaphragms;

means for controlled intake and discharge of a transient fluid to be pumped to and from, respectively, said remote side of each pumping diaphragm; and means for cyclically providing a pressurized fluid to said pressurizing side of each pressurizing diaphragm to cause said movement of each pair of diaphragms for causing pumping of the transient fluid by each said pumping diaphragm, wherein the fluid pressure within the sealed enclosure formed by each pair of diaphragms increases during the movement of the respective pressurizing diaphragm in the pumping direction, thereby exerting a force on the respective pumping diaphragm.

* * * * *